United States Patent [19]

Hinchcliffe

[11] 4,181,212

[45] Jan. 1, 1980

[54] METHOD AND APPARATUS FOR FEEDING CONTAINERS FOR ROD-LIKE ARTICLES

[75] Inventor: Dennis Hinchcliffe, London, England

[73] Assignee: Molins, Ltd., England

[21] Appl. No.: 884,570

[22] Filed: Mar. 8, 1978

Related U.S. Application Data

[63] Continuation-in-part of Ser. No. 651,532, Jan. 22, 1976, abandoned.

[30] Foreign Application Priority Data

Jan. 31, 1975 [GB] United Kingdom ..... 4231/75

[51] Int. Cl.[2] ..... B65G 47/26

[52] U.S. Cl. ..... 198/419; 53/148; 198/425; 198/429

[58] Field of Search ..... 198/419, 425, 429; 53/148, 236, 245; 214/300, 309, 315, 16.4 C

[56] References Cited

U.S. PATENT DOCUMENTS

| | | | |
|---|---|---|---|
| 3,250,056 | 5/1966 | Rodszinat et al. | 53/236 |
| 3,308,600 | 3/1963 | Eromann et al. | 53/148 X |
| 3,365,857 | 1/1968 | Liedtke | 53/148 |
| 3,967,740 | 7/1976 | Molins | 53/148 X |

*Primary Examiner*—Robert B. Reeves
*Assistant Examiner*—Douglas D. Watts
*Attorney, Agent, or Firm*—Craig and Antonelli

[57] ABSTRACT

A feed system for trays for rod-like articles such as cigarettes in which trays are removed from a conveyor (such as a trolley) at one level, moved to another level at which they are advanced to a loading (or unloading) position, and moved back to the first level (after loading or unloading) before being returned to the conveyor. Trays may be loaded or unloaded while moving stepwise between levels and may be removed from and returned to the conveyor along separate parallel paths.

9 Claims, 6 Drawing Figures

METHOD AND APPARATUS FOR FEEDING CONTAINERS FOR ROD-LIKE ARTICLES

This application is a continuation-in-part of application Ser. No. 651,532, filed Jan. 22, 1976, now abandoned.

This invention relates to a method and apparatus for feeding containers for rod-like articles.

In the tobacco industry it is common during manufacturing processes to require cigarettes or filter plug lengths to be transported or temporarily stored in containers. These containers often take the form of trays in which the cigarettes or other rod-like articles are received so that their lengths lie in the direction of the depth of the tray.

In U.S. Pat. No. 3,967,740, the disclosure of which is hereby incorporated herein in full, apparatus is described for loading rod-like articles into containers in which a batch consisting of a stack of articles is plunged endwise from a conveyor into a container. The container is moved successively stepwise to receive successive batches formed on the conveyor and when full the container is moved and replaced with an empty container. Apparatus is also described in which full containers are supplied successively to an unloading station where they are converted into empty containers, the rod-like articles removed from the containers in batches being formed into a continuous stream.

U.S. application Ser. No. 648,926, the disclosure of which is also hereby incorporated herein in full, concerns somewhat similar apparatus in which batches of rod-like articles are successively plunged into a stepwise-moving container. Unloading apparatus in which batches removed from containers are formed into a continuous stream of rod-like articles is also disclosed in this application.

The apparatus and method for feeding containers disclosed in the present application may be used with the apparatus disclosed in the above-mentioned U.S. Pat. No. 3,967,740 and the U.S. application Ser. No. 648,926.

According to one aspect of the present invention, there is provided apparatus for feeding containers for rod-like articles to a loading or unloading position comprising conveyor means for containers at a first level, means for withdrawing a container from the conveyor means and moving it to a second level, means for advancing the container at the second level, means for moving the container from the second level to the first level, and means for receiving the container at the first level and for returning it to the conveyor means, said loading or unloading means being located so that the container passes through said position while moving between the first and second levels.

The container may be moved towards the loading or unloading position by said advancing means and then moved through said position by the means for moving the container from the second to the first level.

The conveyor means may comprise container holders which move into discrete positions as said conveyor means moves; preferably containers are withdrawn from and returned to the conveyor means at adjacent positions. The conveyor means may comprise a plurality of trolleys, each having several container holders, movable on a track system.

Preferably the means for receiving a container at the first level is operative to retract the container from the line of movement through the loading or unloading position before the container is returned to the conveyor means.

Containers are preferably moved stepwise through the loading or unloading position so that successive batches of rod-like articles may be transferred to or from an adjacent conveyor.

Each container may be a rectangular tray which is moved so that one pair of sides is horizontal and the other pair vertical; the second level is then preferably spaced from the first level by a distance exceeding the length of the vertical sides of the tray.

Another aspect of the invention provides a method of feeding containers for rod-like articles to a loading or unloading position in which containers are successively withdrawn from a supply at a first level along a first path, moved to a second level, and returned to the first level, the containers passing through the loading or unloading position while moving between the first and second levels, wherein the containers are returned to said supply along a second path parallel to the first path.

Preferably containers are moved along the first and second paths simultaneously in opposite directions.

Preferably said supply comprises conveyor means defining a supply stream, the second path being spaced from the first path in a direction downstream relative to the stream.

Where containers pass through the loading or unloading position while moving from the second to the first level, they are preferably moved at the second level toward the loading or unloading position in a direction parallel to said stream. At the first level, containers received from the second level after passing through the loading or unloading position may also be moved parallel to the stream, but in the opposite sense, before being returned to the stream.

The second level may be above or below the first level. Where containers are fed to a loading position, they are preferably loaded while moving downwards; in the case of an unloading position, the containers are preferably unloaded while moving upwards.

A further aspect of the invention provides apparatus for filling trays with rod-like articles comprising tray conveyor means for supplying a succession of empty trays at a first level, means for successively transversely withdrawing at a predetermined position the leading empty tray from said conveyor means and elevating it to a second level, means for advancing the tray at the second level towards a loading position, the loading position including means for successively transferring batches of rod-like articles from an article conveyor into a tray in the loading position, means for moving the tray stepwise vertically downwards through the loading position to receive successive batches of rod-like articles until the tray is full, means for returning the tray to the first level, means for moving the tray at the first level in a direction parallel and opposite to said advancing movement at the second level, and means for transversely returning the full tray to the tray conveyor means downstream of the empty trays. Preferably, the loading position and the article conveyor are at the second level.

The invention also provides apparatus for unloading trays containing rod-like articles comprising tray conveyor means for supplying a succession of full trays at a first level, means for successively transversely withdrawing at a predetermined position the leading full tray from said conveyor means, an unloading position including means for successively transferring batches of rod-like articles from a tray at the unloading position onto an article conveyor, means for moving the tray upwards from said first level towards a second level and moving it stepwise vertically upwards through the unloading position to transfer successive batches of rod-like articles from the tray until it is empty, means for moving the tray at the second level, means for returning the empty tray to the first level, and means for transversely returning the empty tray to the tray conveyor means downstream of the full trays. Preferably, the unloading position and the article conveyor are at the second level, so that batches in each tray are unloaded at that level. The apparatus may include means for moving said full tray at said first level prior to its upward movement to said unloading position. Trays used with the unloading apparatus preferably either hold single batches or are provided with partitions so that each batch is held in a separate compartment.

Apparatus for loading trays and apparatus for unloading trays, as defined herein, may be embodied in basically the same apparatus which is operable in reversible modes to perform either the loading and unloading function.

A tray is empty when it contains no rod-like articles and is full when it has undergone operations which normally substantially fill it to working capacity with rod-like articles.

The invention will now be further described, by way of example, with reference to the accompanying drawings in which.

Figure 1:
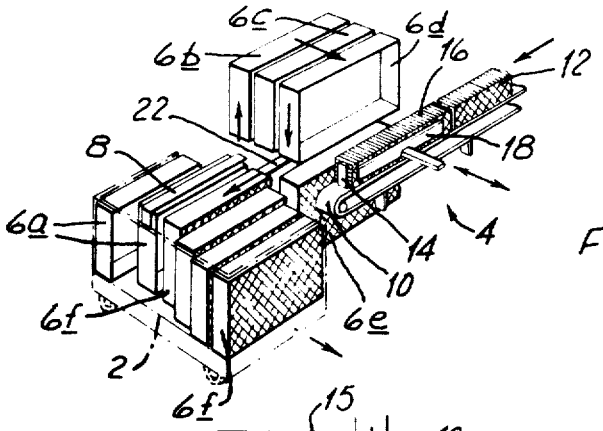
FIG. 1 is a perspective diagrammatic view of apparatus for filling trays with cigarettes.

A trolley 2 is shown alongside a tray filling unit 4. The trolley 2 is one of a number of such trolleys which are movable on a track system, part of which passes the unit 4. Each trolley 2 has provision for holding six trays indicated generally by the reference number 6. The trays 6 are rectangular and are maintained in the trolley 2 so that one pair of sides is vertical, the other pair of sides being horizontal. For this purpose, the trolleys may be provided with partitions. The trays 6 are adapted to hold a stack of cigarettes so that the lengths of cigarettes lie parallel to the depth of the sides of the trays. The trays 6 may have one face, which forms a back when the trays are vertical as in the trolleys 2, or they may be open on both faces so that the sides simply form a frame. The trays 6 may have compartments similar to those of the trays described in U.S. Pat. No. 3,967,740.

Trolleys 2 are moved past the tray filling unit 4 is stepped movement. Each indexing movement of a trolley 2 on the track system normally moves a trolley by a distance equal to the spacing between trays 6 on the trolley. Special provision may be made for identifying gaps between adjacent trolleys, or the normal spacing between the trailing tray in one trolley and the leading tray in the successive trolley, and correcting the movement so that trays in succeeding trolleys are correctly indexed relative to the tray filling unit 4. An arrangement for indexing trolleys is disclosed in said U.S. Pat. No. 3,967,740.

Figure 3:
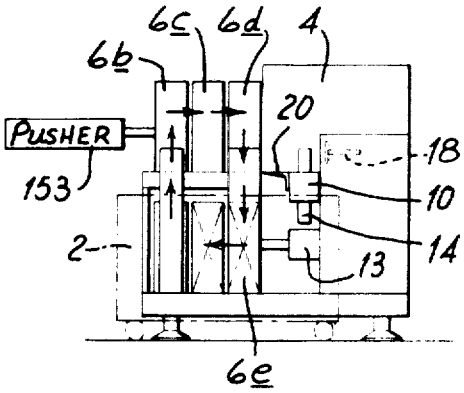
FIG. 3 is an end elevation of the apparatus of FIG. 1.
Figure 4:
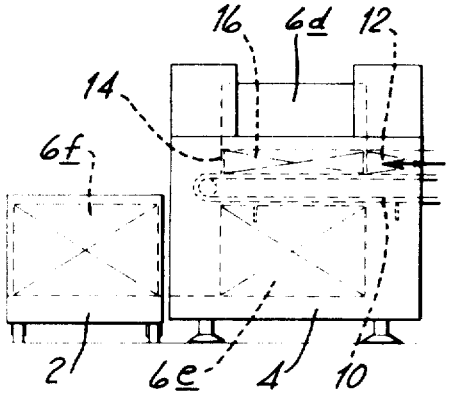
FIG. 4 is a side elevation of the apparatus of FIG. 1.

The trolley 2 is initially supplied with empty trays 6*a*, possibly as supplied from a tray unloading unit. The tray filling unit 4 includes a feed carrier 8 which is operative to engage an empty tray 6*a* in a predetermined position and slide it transversely off its trolley 2 into the unit 4. Within the unit 4 the tray 6*a* is elevated from the level of the trolley 2 to a position 6*b* at an upper level by any suitable elevator arrangement, such as a chain conveyor of the type disclosed in the aforementioned U.S. Pat. No. 3,967,740. The distance through which the tray is elevated to the upper level slightly exceeds the height of the tray. At the upper level the tray in position 6*b* is advanced in stages by a pusher 153 (FIG. 3) through position 6*c* to a loading position 6*d*. The direction of advancement at the second level is parallel to the direction of movement of the trolley 2.

The tray filling unit 4 includes a band conveyor 10 which conveys a stream 12 consisting of a stack of cigarettes moving transverse to their lengths. The stream 12 may be supplied from one or more cigarette making machines (not shown) or from a temporary store. The conveyor 10 carries upstanding divider plates 14 by means of which the stream 12 is successively divided into batches 16. Each batch has a dimension along the conveyor 10 corresponding to the horizontal dimension of a tray 6. A reciprocal plunger 18 is arranged adjacent the conveyor 10 and opposed to a tray 6 in the loading position 6*d*. The plunger 18 is operable to plunge batches 16 successively off the conveyor 10 across a transfer plate 20 and into a tray at position 6*d*. An empty tray which has arrived at the loading position 6*d* receives a first batch on its lowermost side. Subsequently, the tray is moved vertically downwards through a distance approximately equal to the height of a batch in order to receive the next batch from the conveyor 10 on top of the preceding batch. The tray is moved downwards to receive successive batches until it is full. A typical tray may accommodate four batches. For further details of a filling operation of this type, reference is directed to said U.S. Pat. No. 3,967,740 and to the aforementioned U.S. patent application Ser. No. 648,926.

After a tray has moved through the loading position, it is lowered vertically to a position 6*e* at its original level. As it is still vertically below the loading position, it is moved horizontally away from position 6*e* by a pusher 13 in a direction parallel to but in the opposite sense to movement of the trolley 2. This ensures that there is no interference between the filled tray which occupied position 6*e* and the next tray being filled from position 6*d*.

The full tray 6*f* is removed from the unit 4 by means of a return carrier 22 which slides the tray outward of the unit 4 and partially back into a compartment in the trolley 2. A sloping guide member 24 mounted on the unit 4 adjacent the path of a trolley 2 is operative to slide full trays 6*f* fully back into the compartment as the trolley moves past it. It should be noted that the carriers 8 and 22 operate along parallel paths on adjacent trolley compartments. Thus, trolleys 2 carrying empty trays 6*a* are successively converted into trolleys carrying full trays 6*f*.

After an empty tray 6*a* has been withdrawn from a trolley 2 into the unit 4, the trolley 2 is indexed one position and the tray is elevated in the unit to its upper level. Subsequently, a further empty tray 6a is withdrawn into the unit. After each stage of operation of the feed carrier 8, the trolley 2 is indexed by one position. Individual trays within the unit 4 are correspondingly moved through one stage in order to allow room for another tray to be fed by the feed carrier 8. The number of separate stages of movement within the unit 4, corresponding to the number of operations of the feed carrier, determines the number of trays within the unit at any one time during continuous operation and is variable. If, for example, there are five trays in the unit 4 at any one time, then the trolley will index five times while any one tray is in the unit 4. Moreover, if, as is preferable, the feed and return carriers operate simultaneously, any one tray after having been filled is returned to the compartment in a trolley previously occupied by the empty tray four compartments behind it (this because the return carrier operates on a compartment one position downstream of the feed carrier).

The apparatus is operable in a reverse mode as unloading apparatus for full trays. The directions of movement of the conveyor 10 and the trolleys 2 are reversed and the feed and return carriers must be capable of operation in reverse. Full trays fed to position 6e are emptied as they are elevated stepwise past the conveyor 10 to position 6d. The plunger 18 may be provided with suction means (see U.S. patent application Ser. No. 648,926) for withdrawing successive batches of cigarettes and depositing them on the conveyor 10 between divider plates 14, which are subsequently withdrawn to form a continuous stream on the conveyor. For use with compartmented trays, scoop means may be provided on the plunger 18 (see U.S. Pat. No. 3,967,740). Alternatively, a plunger opposed to the plunger 18 may be used with compartmented open-backed trays (also disclosed in U.S. Pat. No. 3,967,740). The emptied trays are fed through the unit 4 in reverse direction to be returned by carrier 8 to the trolley. Thus, trolleys of full trays may be converted to trolleys of empty trays by the apparatus working in reverse.

Figure 2:
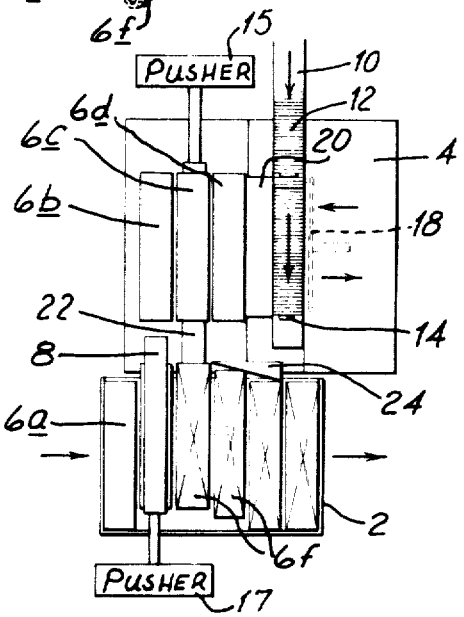
FIG. 2 is a plan view of the apparatus of FIG. 1.

Movement of trays within the unit 4 may be achieved by use of driver belts and/or chains as already known. As shown in FIG. 2, the carriers 8 and 22 could be operated by pistons or pushers 17 and 15, respectively, or, alternatively, they could be mounted on driven rotatable threaded rods so that rotation of the rod (in the appropriate direction) causes the required transverse movement of the carrier.

Figure 5:
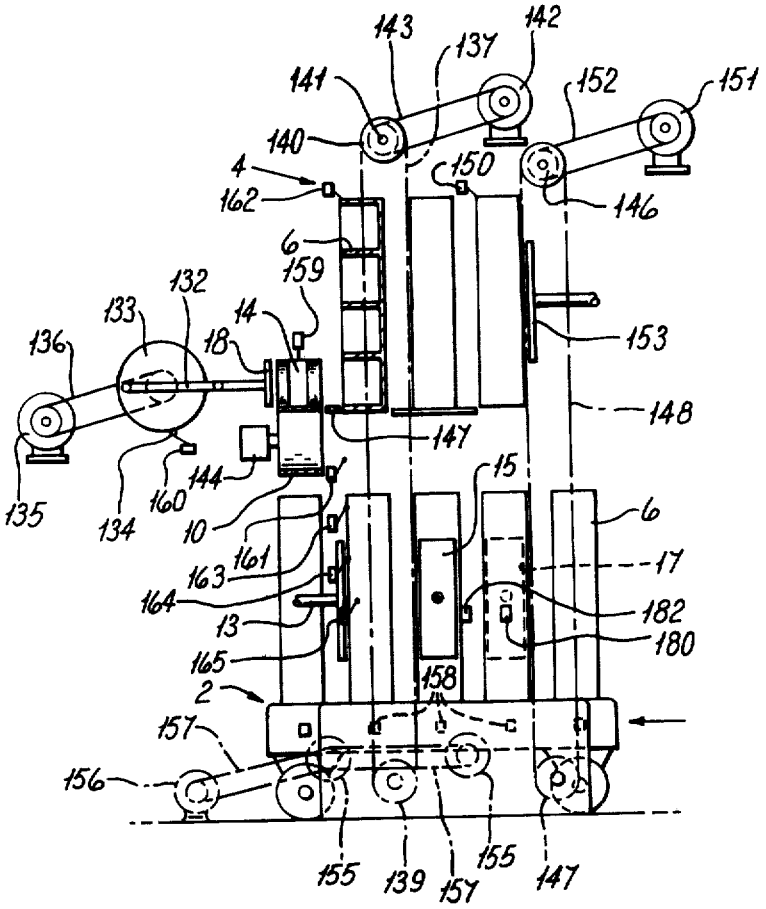
FIG. 5 is a diagrammatic side view of apparatus for filling trays with cigarettes, showing details of conveying means for the trays.
Figure 6:
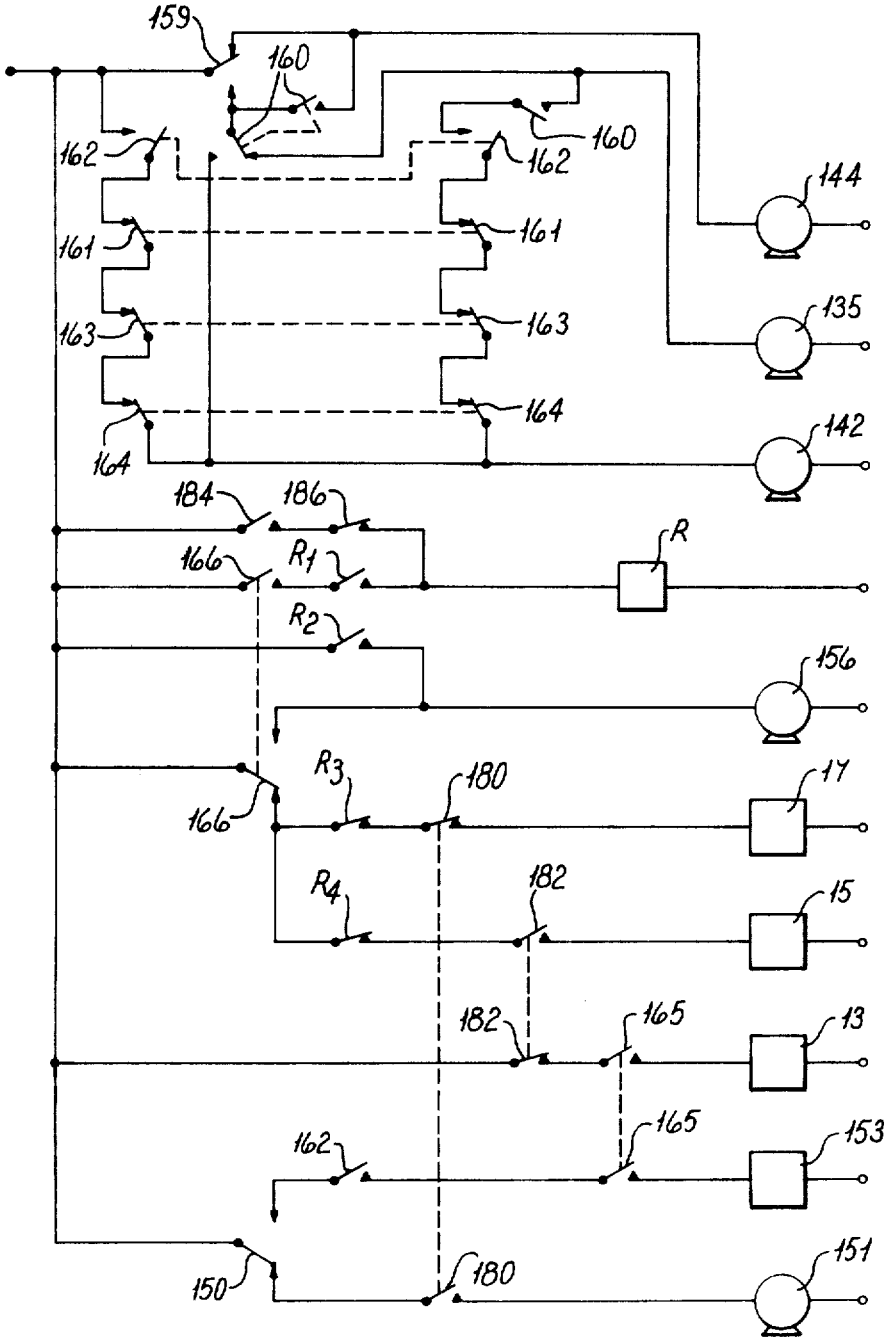
FIG. 6 is a schematic diagram of a circuit for controlling the apparatus of FIG. 5.

One possible arrangement for moving the trays within the unit 4 is shown diagrammatically with reference to FIGS. 5 and 6. The arrangement is somewhat similar to that proposed for the storage unit S.U. disclosed in U.S. Pat. No. 3,967,740 to which reference is directed. The apparatus of FIG. 5 is basically similar to that of FIG. 1; and, in general and where possible, similar reference numbers have been used for similar parts.

Referring first to FIG. 5, the conveyor 10 is driven from a motor 144. The pusher 18 is connected, by a connecting rod 132, to a crank disc 133 provided with a projection 134, and drivingly connected to a motor 135 by a chain 136.

A pair of vertical endless chain conveyors 137 is positioned adjacent the conveyor 10 on the opposite side from the pusher 18, the chains being spaced by a distance such that a tray 6 may be lowered past the pusher 18. For this purpose, each chain 137 has a projection fixed to it which can engage lugs on the tray 6. The chains 137 extend between lower freely rotatable sprockets 139, and upper sprockets 140, the latter being fixed to a common drive shaft 141 which is driven from a motor 142 by a chain 143.

A further pair of tray-engaging chains 148, passing around sprockets 146, 147 and driven by a motor 151 by means of a chain 152, is provided at a position spaced from the chains 137 in a direction away from the conveyor 10.

Trolleys 2 are moved stepwise relative to the unit 4 by a pair of drive members 155, driven in unison from a motor 156 by chains 157. The construction of the trolley 2 is similar to that of the trolleys 80 and 154 described with reference to FIGS. 14, 15, 19, and 20 of said U.S. Pat. No. 3,967,740. The trolley 2 has a number of projections 158 along the side nearest the drive members 155, corresponding to the number of trays carried by the trolley.

In operation, cigarettes are delivered to the unit 4 on conveyor 10, which carries divider plates 14 for separating the cigarettes into batches 16. When a batch reaches the loading position, the leading plate 14 operates a switch 159 which causes the motor 144 for conveyor 10 to stop and the motor 135 to start. This causes the pusher 18 to move the batch of cigarettes from the conveyor 10 across the bridge piece 147 and into the waiting compartment of the tray 6. Before the pusher 18 is fully returned to its starting position, the projection 134 on crank 133 operates a switch 160 which causes motors 142 and 144 to start and motor 135 to stop.

The operation of motor 142 moves the chains 137 so that the tray 6 is moved downwards until it operates a switch 161 which stops the motor 142, at which time the next compartment is positioned opposite the pusher 18. At the same time the next batch of cigarettes is being moved into position on conveyor 10. As the tray starts to move downwards, a switch 162 causes switch 160 to be by-passed and motor 135 to start, which brings the pusher 18 back to its starting position. When the pusher 18 reaches this position, the projection 134 disengages from switch 160, which causes motor 135 to stop. The tray remains stationary until the next divider plate 14 operates switch 159 and the cycle of operations above-described is repeated to fill the next compartment of the tray. After this cycle of operations has been carried out four times, all four compartments in the tray will be filled with cigarettes. It should be noted that the tray is stopped during each cycle after the first cycle of operations by successive switches 161, 163, and 164, and it is these switches in turn which cause the switch 160 to be by-passed, so that the pusher 18 may be returned to its starting position.

After the tray has been completely filled, the motor 142 will be started, as described above, and the tray moved downwards until it reaches a platform in the unit 4 at the level of the trolley 2. At this time the chains 137 are still moving and the projections which engage the lugs on the tray 6 move away until one of them operates a switch 165 which causes the motor 142 and therefore the chains 137 to stop. Subsequently, assuming a limit switch 182 is closed, indicating an absence of another tray in its path, the tray 6 is retracted by the pusher 13, and when, at the end of the movement of the pusher 13, the limit switch 182 is opened by the tray itself, the pusher 15 is operated to replace the full tray in the stationary trolley 2, the pusher 13 returning to the position shown in FIG. 5.

When the trolley 2 arrives at the position shown in FIG. 5, one of the projections 158 on the trolley operates a switch 166 (FIG. 6) which stops the motor 156, and therefore the trolley. The empty tray 6 is transferred into unit 4 by means of the pusher 17. Operation of a switch 184 (FIG. 6) by the pusher 17 after its stroke (i.e., when it has returned to its retracted position) causes the switch 166 to be temporarily by-passed and the motor 156 to start. This causes the drive members 155 to rotate and the trolley 2 to be moved, to position the next empty container adjacent the pusher 17. When the trolley 2 reaches this position, the next projection 158 operates switch 166 which causes motor 156 to stop, and the pusher 17 removes the next empty tray from the trolley. It should be noted that limit switch 180 only allows pusher 17 to operate when the unit 4 is clear of trays in its path. At the end of the stroke of pusher 17, the tray operates switch 180 which stops movement of the pusher 17 and also allows movement of the motor 151 for chains 148, assuming that the switch 150 indicates that the path is clear for the tray to be lifted by the chains 148. Similarly, after being lifted by the chains 148, the tray operates the switch 150 which actuates the pusher 153 to move the tray at the upper level across to the loading position, assuming that the switches 162 and 165 indicate that there is no tray in or passing through the loading position.

The tray is then loaded under operation of the chains 137, retracted by pusher 13, and returned to the trolley by pusher 15, in the way previously described.

It should be noted that the switch 184 (operated by the pusher 17 after its stroke) which causes the switch 166 to be temporarily by-passed and the motor 156 to move the trolley 2, operates in conjunction with a further switch 186 (FIG. 6) which is closed as long as the pusher 15 is in its retracted position. This ensures that the trolley 2 is not moved while either of the pushers 15, 17 are operating.

FIG. 6 is a schematic diagram of electric circuits embodying the various switches and motors referred to above, to obtain the movements and operation described. It should be noted that a relay R, having four contacts R1–R4, is included for operation of the motor 156 to move the trolley 2 and to prevent operation of the pushers 15, 17 while the trolley is moving.

With respect to operation of the pushers 13, 15, 17, and 153, it may be noted that these are operated by simple switching which, for example, may comprise a solenoid-controlled valve to allow pressure air to a piston, which after the operative stroke is automatically exhausted and returned by resilient means. Alternatively, the pushers could be moved by motors and controlled in an analogous way to the motor 135 for pusher 18.

While I have shown and described one embodiment in accordance with the present invention, it is to be understood that the same is not limited thereto but is susceptible of numerous changes and modifications as known to those of ordinary skill in the art, and I, therefore, do not wish to be limited to the details shown and described herein but intend to cover all such changes and modifications as obvious to those skilled in the art.

What is claimed is:

1. Apparatus for filling trays with rod-like articles comprising tray conveyance means for supplying a succession of empty trays at a first level, means for successively transversely withdrawing at a predetermined position and along a first path the leading empty tray from said conveyance means, means for elevating said tray from said first path to a second level, a loading position, means for advancing the tray in stages at the second level towards the loading position so that each tray passes through an intermediate stage at which it is temporarily held before advancing further, an article conveyor, the loading position including means for successively transferring batches of rod-like articles from said article conveyor into a tray in the loading position, means for moving the tray stepwise vertically downwards through the loading position to receive successive batches of rod-like articles until the tray is full, while returning the tray to the first level, means for moving the tray at the first level in a direction parallel and opposite to said advancing movement at the second level, and means for transversely returning the full tray to said conveyance means along a second path parallel to said first path and downstream of the empty trays.

2. Apparatus as claimed in claim 1 wherein the means for returning a full tray to the tray conveyance means includes stationary guide means arranged downstream of said second path relative to said conveyance means.

3. Apparatus for unloading trays containing rod-like articles, comprising tray conveyance means for supplying a succession of full trays at a first level, means for successively transversely withdrawing at a predetermined position and along a first path the leading full tray from said conveyance means, an article conveyor, an unloading position including means for successively transferring batches of rod-like articles from a tray at the unloading position onto said article conveyor, means for moving the tray from the first level towards a second level stepwise vertically upwards through the unloading position to transfer successive batches of rod-like articles from the tray until it is empty, means for moving the tray at the second level and for temporarily holding the tray in an intermediate position at said second level, means for subsequently returning the empty tray to the first level, and means for transversely returning the empty tray to said tray conveyance means along a second path parallel to said first path and downstream of the full trays.

4. Apparatus as claimed in claim 3 wherein the means for returning an empty tray to the tray conveyance means includes stationary guide means arranged downstream of said second path relative to said conveyance means.

5. A method of feeding articles for rod-like articles to an article transfer position, comprising the steps of successively withdrawing containers from a supply at a first level along a first path, raising the containers to a second level, advancing said containers on said second level toward said article transfer position, temporarily holding said containers at an intermediate position on said second level, advancing said containers from said intermediate position to said transfer position and returning the containers to the first level, the containers passing through said article transfer position while moving between the first and second levels, wherein the containers are returned to said supply along a second path parallel to the first path.

6. A method as claimed in claim 5 in which containers are moved along the first and second paths simultaneously in opposite directions.

7. A method as claimed in claim 6 in which the supply comprises conveyance means defining a supply stream, the second path being spaced from the first path in a direction downstream relative to said stream.

8. A method as defined in claim 7, wherein the containers pass through said article transfer position while moving from the second level to the first level, in which the containers are moved at the second level toward said article transfer position in a direction parallel to said supply stream.

9. A method as claimed in claim 8 in which said containers returned to the first level are moved at said first level in a direction parallel to said supply stream before being returned to said stream.

* * * * *